US005878683A

United States Patent [19]

Kyle

[11] Patent Number: 5,878,683

[45] Date of Patent: Mar. 9, 1999

[54] DRIVE MEMBER AND LINE GUIDE FOR A ROLLER FURLER

[75] Inventor: James H. Kyle, Keene, N.H.

[73] Assignee: Pompanette, Inc., Charlestown, N.H.

[21] Appl. No.: 926,681

[22] Filed: Sep. 10, 1997

[51] Int. Cl.[6] ..... B63H 9/10

[52] U.S. Cl. ..... 114/106; 114/107

[58] Field of Search ..... 114/104–107

[56] References Cited

U.S. PATENT DOCUMENTS 3,980,036 9/1976 Crall ..... 114/106

4,821,664 4/1989 Dahmen ..... 114/107

*Primary Examiner*—Sherman Basinger

*Attorney, Agent, or Firm*—Dougherty & Troxell

[57] ABSTRACT

A plastic roller furling apparatus includes an elongated member or furling element and a pair of longitudinally extending parallel wires encased therein. The member also defines a central opening or passageway which extends therethrough. This passageway is dimensioned or sized to fit loosely around a stay in which the apparatus is installed. The furling element also includes one and preferably two grooved luff foils which are formed in and extend along the length of the plastic member. Split bearing elements are provided at or near the base of the plastic member and a furling drum or jib sail spool is provided for rotating the plastic member about a stay to furl the sail. The plastic member also includes first and second longitudinally extending segments which extend along the length of and divide the plastic member into two pieces. The segments each include integral fasteners for fastening the two segments together along their length. A split body member is also provided and clamps around the elongated plastic member. This split body member may include a first bearing element for engagement with a split bearing which is installed over the stay.

17 Claims, 8 Drawing Sheets

DRIVE MEMBER AND LINE GUIDE FOR A ROLLER FURLER

FIELD OF THE INVENTION

This invention relates to a drive unit and line guide for a roller furler and more particularly to a snap on drive unit and line guide that can be readily installed and removed on a headstay with the headstay intact and in place.

BACKGROUND OF THE INVENTION

Roller furling systems, such as disclosed in the U.S. Pat. No. 3,789,790 of Crall, have been in use for many years. Such systems typically include a sleeve or torsion element which surrounds a forward stay on a sailboat. The systems also typically include means such as a jib sail spool which sits on and rotates about a bearing for winding and unwinding i.e., furling or unfurling a sail. Means are also provided for rotating the jib sail spool.

More recent developments such as those disclosed by Hood, U.S. Pat. No. 4,248,281 and Dahmen, U.S. Pat. No. 4,821,664 have facilitated sail changes and led to an increased demand for roller furling devices.

Nevertheless, there are a number of shortcoming associate with the prior art roller furlers and it is believed that there may be a large commercial demand for a roller furler which overcomes those shortcomings. For example, roller furlers are typically installed over an existing headstay and require some disassembly of the standing rigging. For this reason, a number of sailors are intimidated by the installation and then turn to a professional which adds to the cost of the roller furler. Some sailors may also be intimidated by the cost of a typical roller furler and would be attracted to a less expensive device.

It has now been found that a roller furling apparatus in accordance with the present invention overcomes the aforementioned shortcomings and offers a number of advantages over prior art furlers. For example, roller furlers in accordance with the present invention are designed for installation over an existing headstay with a headstay intact and in place. Accordingly, the roller furler can be sold in kit form and be readily installed by relatively unskilled individuals using only readily available tools. In addition, the roller furlers in accordance with the present invention are relatively light in weight and flexible over their length so that they can be coiled for packaging and shipment and at the same time provides torsional rigidly after installation. The roller furling apparatus in accordance with the present invention are also durable, inexpensive to manufacturer and present a pleasing appearance without outward projections which might damage a sail.

A further feature of the present invention resides in a split drum or jib sail spool and free floating line guide which can be installed over an existing headstay with the headstay intact and in place.

While the drive roller and line guide in accordance with the present invention have been designed primarily for use with a roller furling apparatus as described and claimed in my co-pending application entitled Roller Furling Apparatus, Ser. No. 08/926,680 which was filed on Sep. 10, 1997, it is believed that they will have broader application. For example, it may be desirable to incorporate the drive roller and line guide as disclosed and claimed herein in a more conventional roller furler which is installed by releasing the headstay from the forward portion of the watercraft. In such apparatus, the lower spool and line guide can be readily removed for racing conditions.

BRIEF SUMMARY OF THE INVENTION

In essence, the present invention contemplates an improved roller furling apparatus which includes a line guide and drive unit which can be installed and removed from the stay of a sailboat without any need to release the headstay from a water craft. The apparatus comprises a first elongated member having a base portion and a longitudinally passageway extending therethrough. The passageway is dimensioned to fit loosely around a stay on which the apparatus is installed. The apparatus also includes a grooved luff foil extending along the length of the first elongated member for receiving a luff edge of a sail. The apparatus also includes a first bearing element which is dimensioned to fit around the stay of a sailboat and a body member including a second bearing element and an elongated portion which fits around the base portion of the first elongated member in clamping engagement therewith. A second bearing element also passes around the stay and is in sliding engagement with the first bearing element for rotational movement with respect to the first bearing element. Means are also provided for maintaining the body member in clamping engagement with the first elongated member, and rope means for rotating the first elongated member and the body member to thereby furl or unfurl a sail.

In a preferred embodiment of the invention, the body member includes a pair of parallel longitudinally spaced grooves which extend around the outer surface thereof and a pair of split flanges which are adapted to fit within the grooves. The split flanges also include alignment means such as a pair of pins and recesses for aligning the parts of the split flanges in an abutting relationship with the grooves. Each of the flanges also include a grooves in an outer portion thereof. The grooves which extend around the flanges face one another and one adapted to receive a full floating sliding element or line guide therein.

The invention will now be described in connection with the accompanying drawings wherein light reference numerals have been used to designate lite parts.

DETAILED DESCRIPTION OF THE PREFERRED EMBODIMENT OF THE INVENTION

Figure 1:
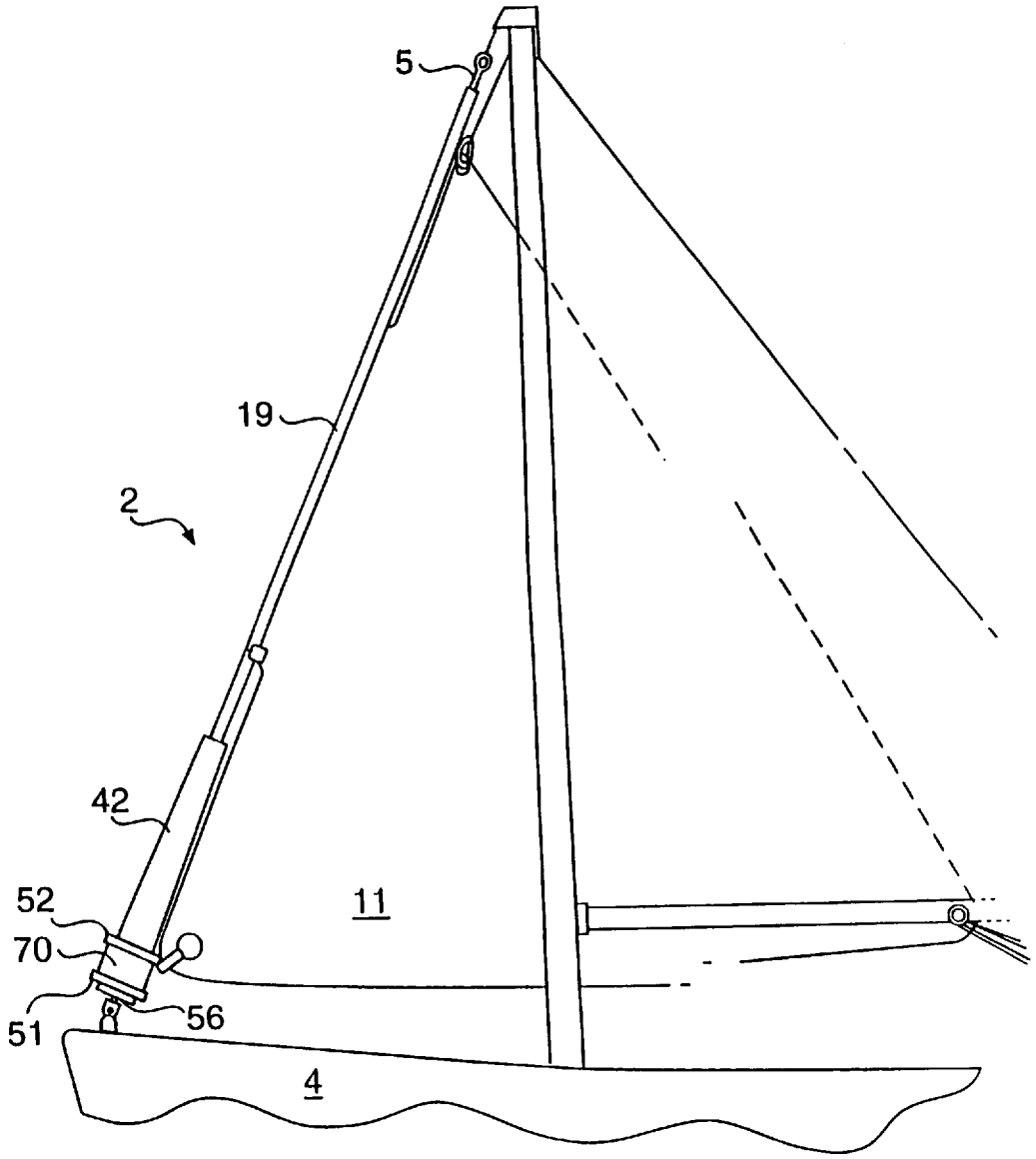
FIG. 1 is a side view of a sailboat provided with a roller furling apparatus in accordance with a preferred embodiment of the invention.
Figure 2:
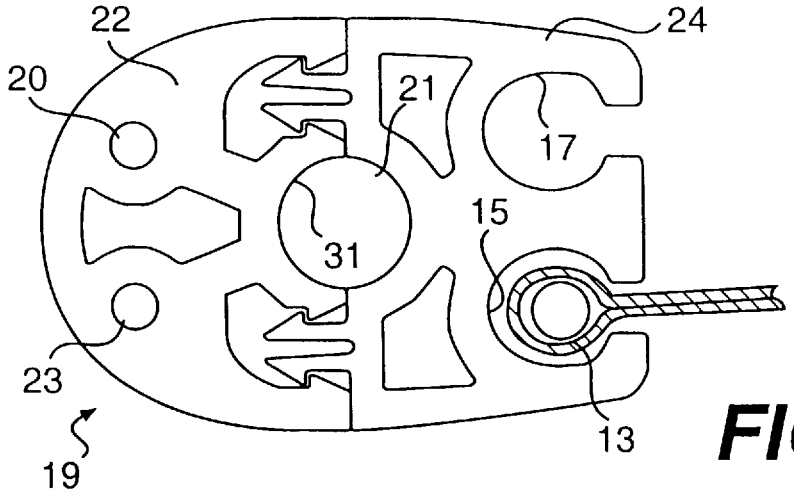
FIG. 2 is a transverse sectional view of a wire reinforced elongated plastic furling element which is employed in the embodiment of the invention which illustrated in FIG. 1.

Referring now to FIGS. 1 and 2, a roller furling apparatus 2 is shown in a sailboat 4 as installed over a headstay 5. As illustrated in FIG. 1, the sailboat 4 carries a jib sail 11 which may take a number of forms. For example, the sail 11 may be of the type referred to as a Genoa jib which is a relatively large sail that overlaps the main sail in a conventional sloop rigged sailboat. The luff edge 13 (FIG. 2) of the sail 11 is typically provided over the major central portion of its length with a bead which fits into a grooved luff foil 15.

Figure 4:
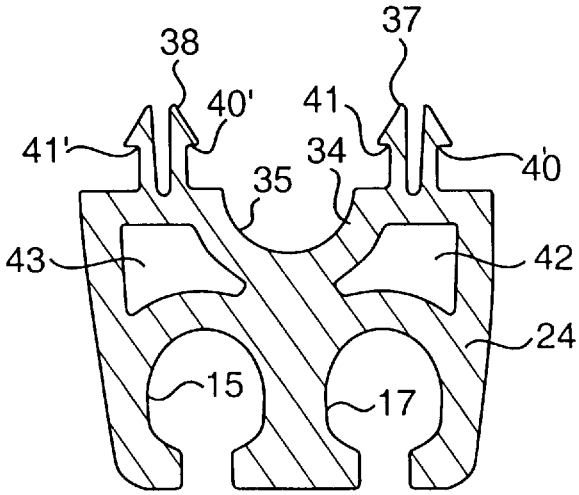
FIG. 4 is a sectional view of the tail segment of the furling element shown in FIG. 2 as it appears before assembly.

As illustrated in FIGS. 2 and 4, the roller furling apparatus 2 includes a pair of luff foils 15 and 17 either of which can receive a jib luff bead. The provision of the double grooves facilitates the use of the same rigging for racing purposes where it may be desirable to frequently change head sails so as to maintain a nearly optimum configuration.

The roller furling apparatus 2 in accordance with one embodiment of the invention comprises an elongated wire reinforced furling element or member 19 which defines or forms a passageway 21. The member 19 is preferably made of a rigid polyvinyl chloride (PVC) extrusion. The passageway 21 has a generally circular or circular cross-section which surrounds or fits over the headstay 5 upon which the apparatus is installed. The furling member 19 includes a pair of longitudinally extending metal wires 20 and 23 (FIGS. 2 and 3) which are preferably 3/32" diameter 7×19 stainless steel wire. The use of parallel wires and twisted strands are preferable since the twisted strands form a better bond with the plastic and together with the parallel structure provide a more rigid structure i.e., provide more torsional rigidity.

Figure 3:
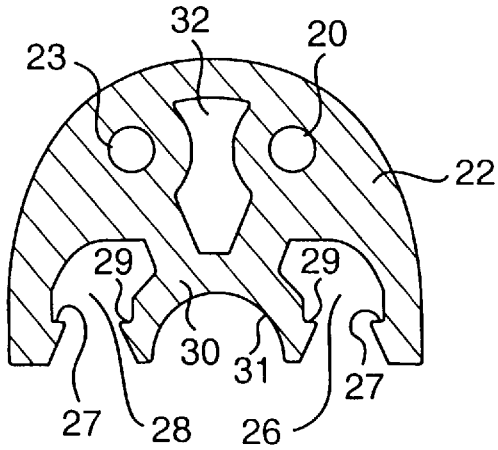
FIG. 3 is a sectional view of the forward or nose segment of the furling element shown in FIG. 2 as it appears before assembly.

In a preferred embodiment of the invention, the plastic member 19 includes 1st and 2nd longitudinally extending segments 22 and 24 (FIGS. 2–4). As illustrated, the first segment 22 or nose piece include the longitudinally extending wires 20 and 23 extruded therein. The segment 22 also includes a pair of longitudinally extending grooves 26 and 28 which extends along the length of the segment 22. Each of the grooves includes a pair of outwardly directed shoulders 27 and 29 respectively, i.e. the shoulders project outwardly from the wall of the grooves toward one another. Each pair of shoulders 27 and 29 form a female portion of an elongated snap fastening means. The segment 22 also includes a longitudinally extending concave portion 30 having a generally semicircular surface 31. The segment 22 may also include a second passageway 32 which reduces the weight of the segment, the amount of plastic required and contributes to the longitudinal flexibility of the segment.

The second longitudinally extending segment 24 or tail section includes the luff foils 15 and 17 and is made of an extruded plastic and of the same material as the nose piece. The second segment 24 also includes a complimentary longitudinally extending concave portion 34 which has a generally semicircular or semicircular surface 35. When aligned, the concave portions 30 and 34 form the passage 21 which surrounds the headstay 5 on which the apparatus is installed. The segment 24 also includes a pair of longitudinally extending outwardly projecting male fastening means 37 and 38 each of which includes a pair of spaced apart and outwardly biased shoulders 40, 41, 40' and 41'. The segment 24 may also include a pair of longitudinally extending passageways 42 and 43 which further reduce the amount of plastic in the extrusions and contributes to the lite weight of the apparatus and the longitudinal flexibility before assembly.

When the segments 22 and 24 are aligned i.e., at the top and bottom thereof with one on each side of the head or jib stay 5, they are snapped together to form a unitary structure as shown in FIG. 2.

One preferred embodiment of the invention also includes a frusto-conically shaped split body member 42 (see FIG. 5) which forms a lower portion of the apparatus 2. The body member 42 is preferably made of glass reinforced nylon. The member 42 includes two longitudinally extending segments 43 and 44 which together define or form a central passageway 45 which fits around a lower portion of the head or jib stay 5.

Figure 7:
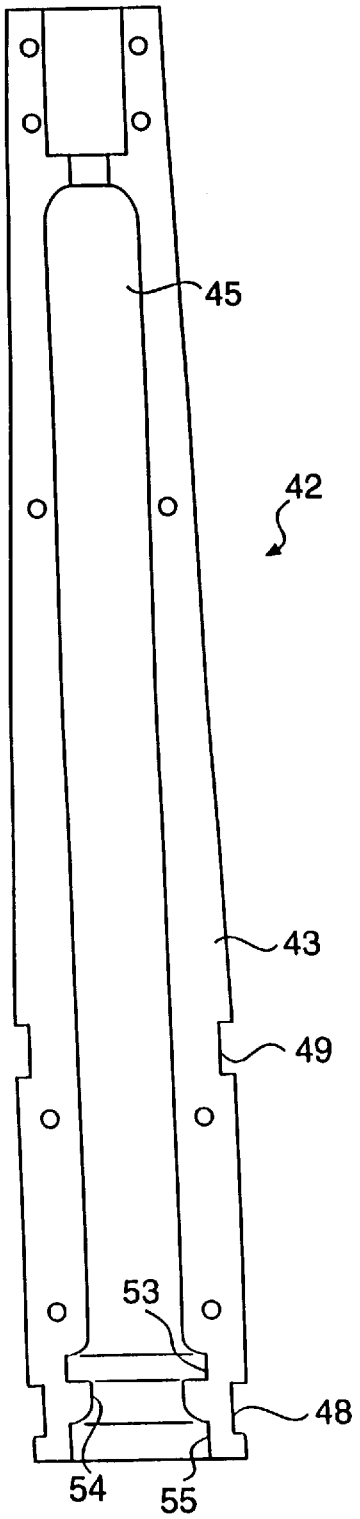
FIG. 7 is a side or plan view showing the other half of the body member of FIG. 6.
Figure 8:
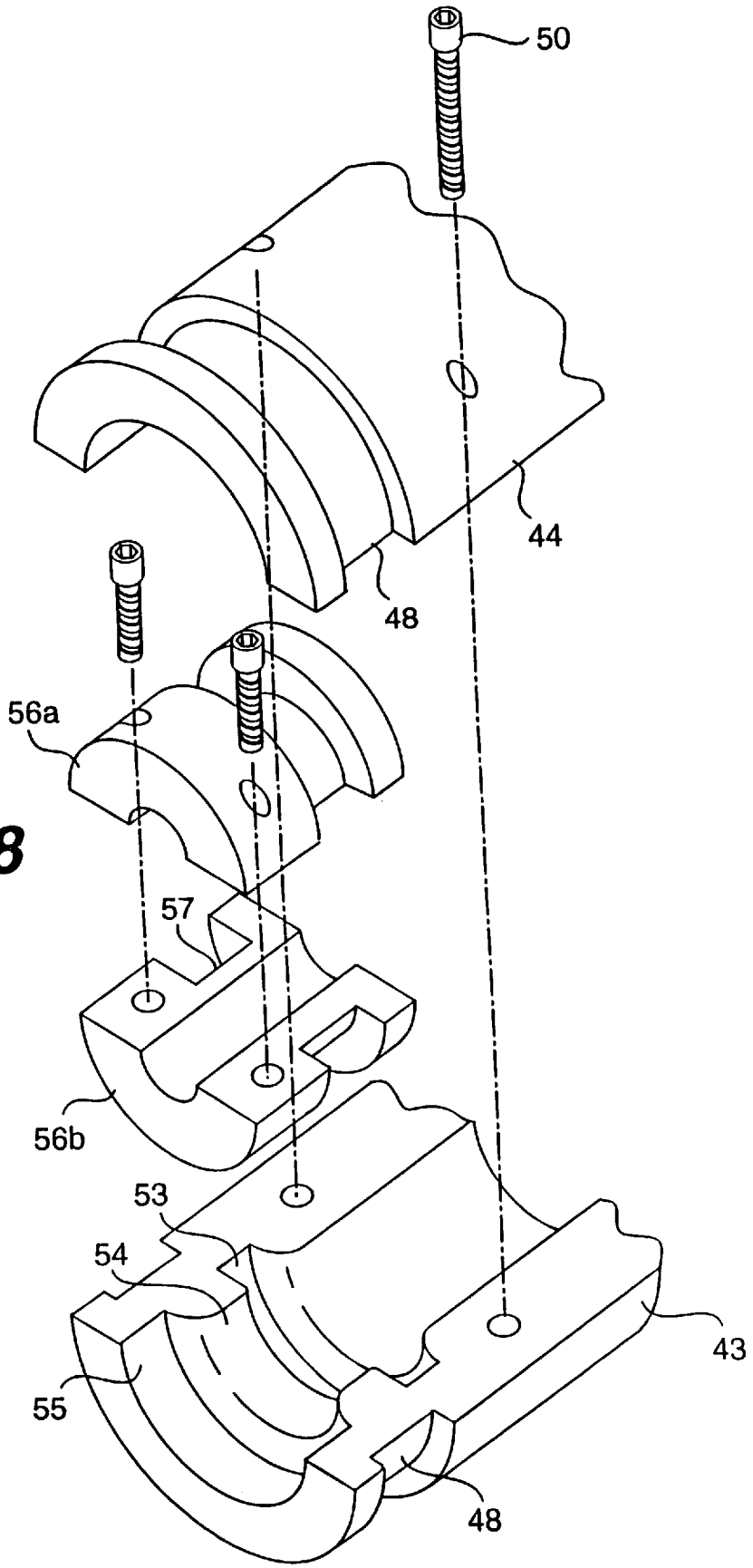
FIG. 8 is an exploded perspective view of a split mounting bearing as used in the apparatus in accordance with the present invention.

The body member 42 encompasses a turnbuckle 47 of the headstay 5 within the passageway 45 and also includes a pair of external transverse grooves 48 and 49 as shown more clearly in FIG. 7. The grooves 48 and 49 extend around the body member 42 in a lower portion thereof when the longitudinally extending segments 43 and 44 are aligned and fastened together about the stay 5. The segments 43 and 44 are fastened together by conventional means such as a plurality of alien set screws 50 as illustrated in FIG. 8.

Figure 5:
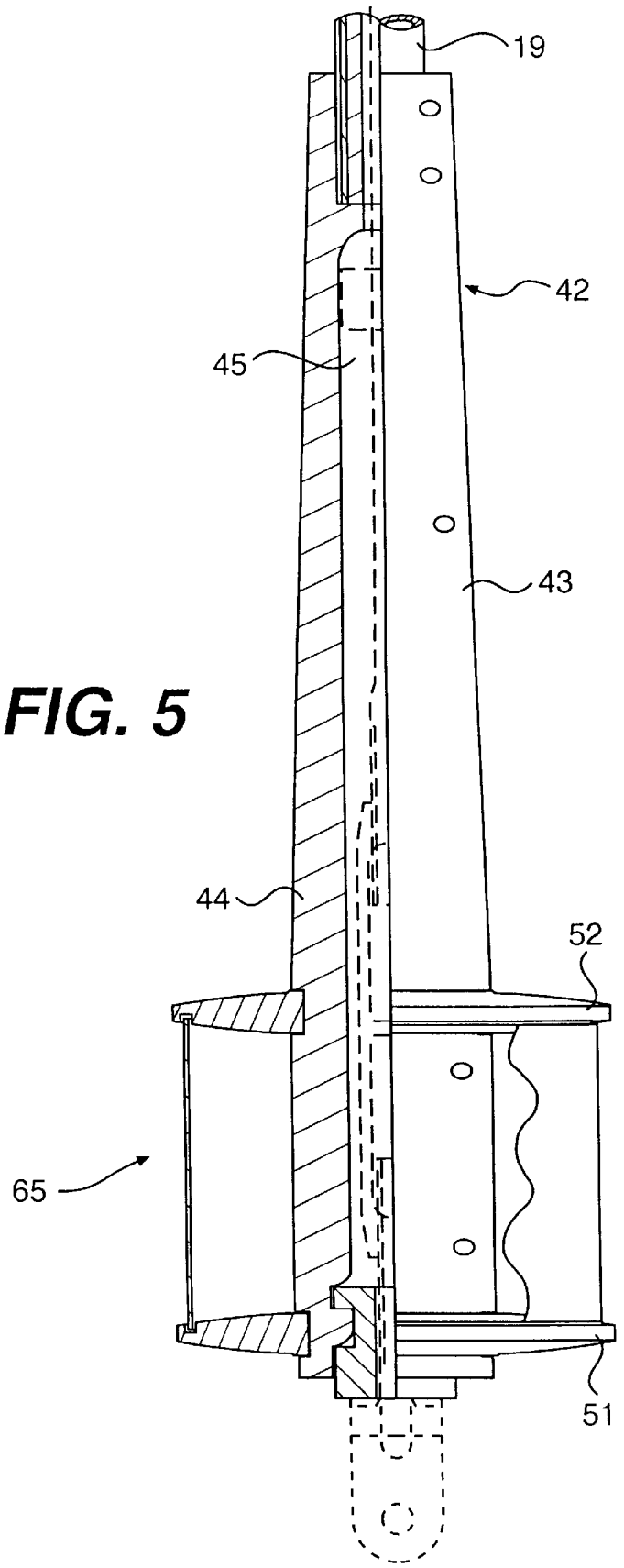
FIG. 5 is a side or plan view partially in section which illustrates a lower portion of the roller furling apparatus in accordance with one embodiment of the invention.
Figure 6:
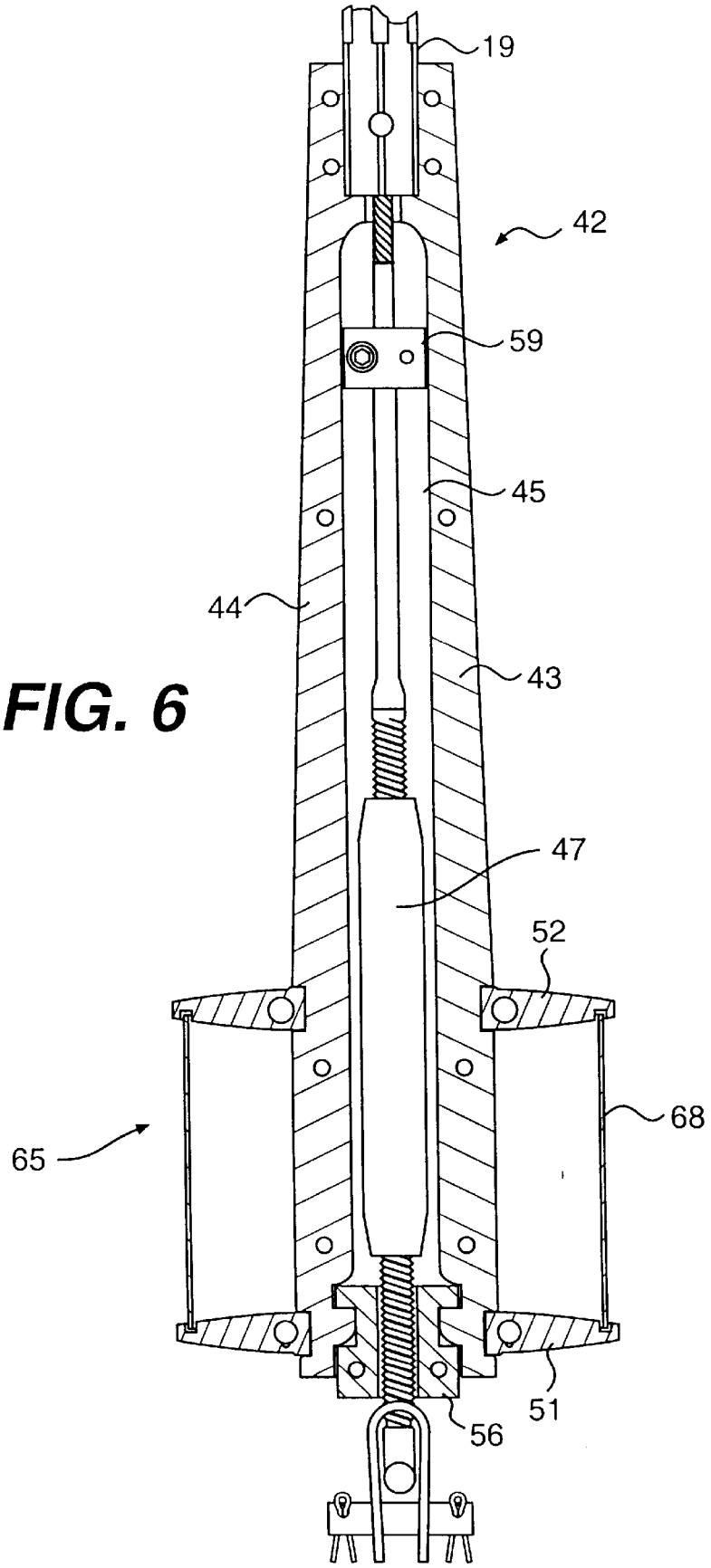
FIG. 6 is a second side or plan view of the portion of the apparatus shown in FIG. 5 after rotating the portion 90° and with one half of a lower body member removed.
Figure 10:
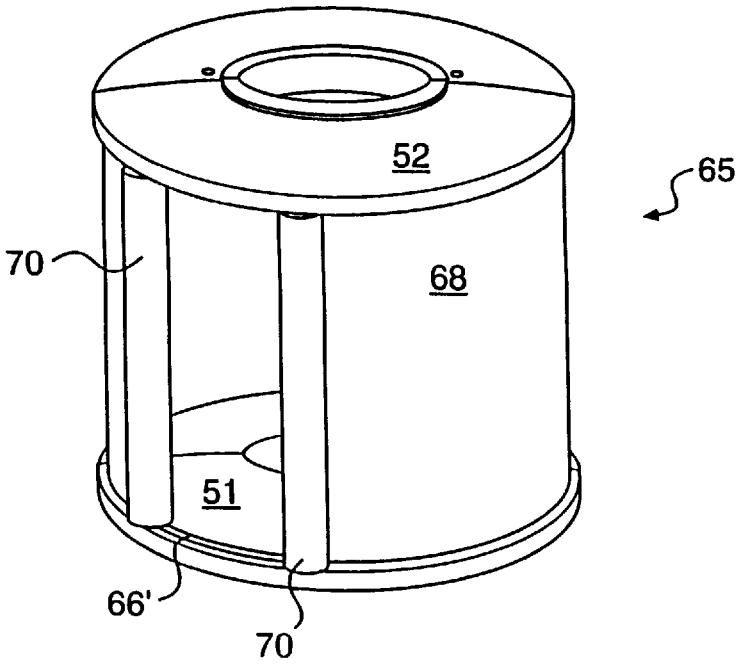
FIG. 10 is a perspective view of the jib spool or drum and floating line guide in accordance with the invention.

The grooves 48 and 49 are constructed and arranged to receive a pair of split flanges 51 and 52 therein as shown in FIGS. 5 and 6. When the split flanges 51 and 52 are snapped around the body member 42 within the grooves 48 and 49 they form a drum or jib spool (see FIGS. 5, 6 and 10) which contains a line or a rope between the flanges. The longitudinally extending segments 43 and 44 each include a pair of transverse internal grooves 53 and 55 (see FIGS. 7 and 8) and a tongue or inwardly directed projection 54 which acts as a bearing element at the base of the body member 42. This lower bearing element clamps around a lower split bearing 56 (see FIG. 6 and 8). The split bearing 56 comprises two halves **56*a* and 56*b* which are clamped around the stay 5 and held in place about the stay by recessed Allen set screws. The bearing 56 also includes a groove 57 in an outer surface thereof and a pair of outward projections which fit within grooves 53 and 55** to complete a lower bearing assembly.

A preferred embodiment of the invention also includes a split nylon spacer 59 in an upper portion of the passageway 45. In essence, the spacer 59 is a generally cylindrical element including two halves which are held together by two allen set screws as shown in FIG. 6. The spacer 59 also defines a cylindrical passageway and clamps around the headstay 5 or a portion of the turnbuckle 47 as shown.

Each of the split flanges 51 and 52 also includes a pair of pins 60 and recesses 62 as well as a ball 61 and detente 63 for snapping the two halves of the flanges together in alignment and for holding the flanges in an abutting relationship with the body member 42.

Figure 9:
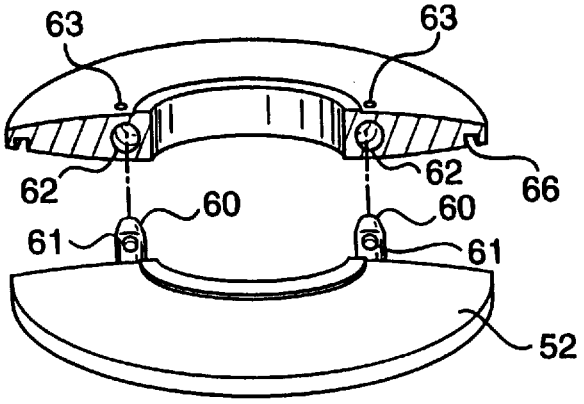
FIG. 9 is an exploded perspective view of a split flange as used in the apparatus in accordance with the present invention.
Figure 11:
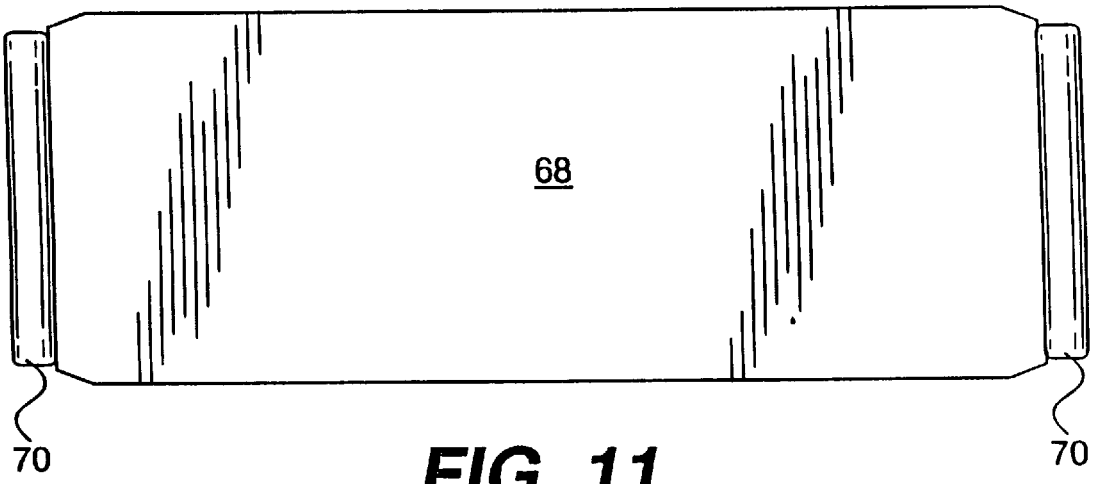
FIG. 11 is a plan view of the slide element as used in the line guide in accordance with the invention but prior to installation.

A floating line guide 65 (see FIG. 10) will be described in connection with FIGS. 5, 6 and 9–11. As illustrated in FIG. 9, each of the flanges 51 and 52 include a shallow groove 66 and 66' which extend around an outer portion of the flange. The sliding element 68 is disposed within the grooves 66, 66' and rotates freely about the body member 42 within the grooves 66, 66'. This sliding element 68 may be made from a sheet of polyethylene or polypropylene or other suitable material. The sliding element may also include a pair of cylindrical elements 70 at each end thereof to protect the sliding element from wear as a line or rope rubs against the element when furling or unfurling a sail. This floating line guide may for example, extend around the flange through an angle of about 270° to 330°.

While the invention has been defined in accordance with its preferred embodiment, it should be recognized that changes and modifications may be made therein without departing from the scope of the appended claims.

What is claimed is:

1. A roller furling apparatus for installation on a stay of a sailboat, said apparatus comprising a first elongated member having a base portion and a longitudinally extending passageway extending there through, said passageway dimensioned to fit loosely around a stay on which the apparatus is installed, a grooved luff foil extending along the length of said elongated member for receiving a luff edge of a sail, a first split bearing element dimensioned to fit around the stay of the sailboat and a split body member having an inner portion which includes a second bearing element, said split body member also including two elongated portions fitting around said base portion of said first elongated member in clamping engagement therewith and with said second bearing element in sliding engagement with said first bearing element for rotational movement with respect to said first bearing element, means for maintaining said body member in clamping engagement with said first elongated member and rope means for rotating said first elongated member and said body member to thereby furl a sail.

2. A roller furling apparatus for installation on a stay on a sailboat in accordance with claim 1, wherein said body member includes outer, upper and lower portions, and wherein said upper portion is maintained in clamping engagement about said first elongated member and wherein said second bearing element is disposed in said lower portion thereof.

3. A roller furling apparatus for installation on a stay of a sailboat in accordance with claim 2, wherein said body member includes a passageway dimensioned to fit around a turnbuckle in a stay of a sailboat.

4. A roller furling apparatus for installation on a stay on a sailboat, said apparatus comprising a first elongated member having a base portion and a longitudinally extending passageway extending therethrough, said passageway dimensioned to fit loosely around a stay on which the apparatus is installed, a grooved luff foil extending along the length of said elongated member for receiving a luff edge of a sail, a first bearing element dimensioned to fit around the stay of the sailboat and a split body member having an inner portion including a second bearing element, and said split body member including two elongated portions fitting around said base portion of said first elongated member in clamping engagement therewith and with said second bearing element in sliding engagement with said first bearing element for rotational movement with respect to said first bearing element, and wherein said split body member includes outer, upper and lower portions with said upper portion maintained in clamping engagement about said first elongated member and with said second bearing element disposed in said lower portion, and wherein said body member includes a passageway dimensioned to fit around a turn buckle in a stay of the sailboat and wherein said apparatus includes a split spacer for clamping around an upwardly extending rod portion of the turn buckle for maintaining the rod portion in a spaced relationship from a wall of the passageway in said body member and rope means for rotating said first elongated member and said body member to thereby furl a sail.

5. A roller furling apparatus for installation on a stay on a sailboat in accordance with claim 4, in which said body member includes a pair of longitudinally spaced grooves in said outer portion thereof, and in which the apparatus includes a pair of split flanges disposed in said grooves for maintaining said rope means within an area between said flanges.

6. A roller furling apparatus for installation on the stay of a sailboat according to claim 5 wherein each of said split flanges includes pin and recess means for aligning and maintaining said split flanges in juxtaposed positions.

7. A roller furling apparatus for installation on a stay on a sailboat according to claim 6, wherein said pin and recess means includes ball and detent means for maintaining said pin and recess means together.

8. A roller furling apparatus according to claim 7 in which said elongated member is plastic.

9. A roller furling apparatus according to claim 8 in which said elongated member is a rigid polyvinyl chloride.

10. A roller furling apparatus according to claim 9 wherein said body member is made of glass reinforced nylon.

11. A roller furling apparatus according to claim 10 in which said flanges are made of glass reinforced nylon.

12. A roller furling apparatus for installation on a stay of a sailboat, said apparatus comprising an elongated member having a base portion with a peripheral area and a longitudinally extending passageway extending therethrough, said passageway dimensioned to fit loosely around a stay on which the apparatus is installed, a grooved luff foil extending along said elongated member for receiving a luff edge of a sail, rope means for rotating said elongated member to thereby furl a sail, a pair of longitudinally spaced grooves in said peripheral area of said base portion and a pair of generally circular flanges with one of said flanges disposed in each of said grooves to thereby form a drum for receiving said rope means, and each of said flanges including a generally circular groove extending around an outer portion of said flange and with said grooves facing one another, and a sliding element slidably disposed within said grooves and extending around a majority of said flange to thereby provide a free floating line guide.

13. A roller furling apparatus according to claim 12 which includes line engaging means for reducing the wear of a line rubbing thereagainst at each end of said sliding element.

14. A roller furling apparatus according to claim 13 in which said sliding element is made of plastic.

15. A roller furling apparatus according to claim 12 which includes a split bearing element and a split body member including a second split bearing element and an elongated portion fitted around said base portion of said first elongated member in clamping engagement therewith and with said second bearing element in sliding engagement with said first bearing element.

16. A roller furling apparatus according to claim 15 in which said sliding element is made of polyethylene.

17. A roller furling apparatus according to claim 15 in which said sliding element is made of polypropylene.

* * * * *